US005174307A

United States Patent [19]

Thompson

[11] Patent Number: 5,174,307

[45] Date of Patent: Dec. 29, 1992

[54] APPARATUS FOR SHIELDING AND PROTECTING THE PELVIC AND CROTCH AREA OF A HUMAN FEMALE

[76] Inventor: Kirk R. Thompson, 1581 Taylor, Penryn, Calif. 95663

[21] Appl. No.: 812,165

[22] Filed: Dec. 23, 1991

[51] Int. Cl.[5] ..... A61F 13/00

[52] U.S. Cl. ..... 128/891; 602/60; 602/70

[58] Field of Search ..... 128/891, 98.1, 158, 128/160, 162; 2/2, 406, 407, 408, 400, 402; 602/70, 71, 72, 73, 60

[56] References Cited

U.S. PATENT DOCUMENTS

| | | | |
|---|---|---|---|
| 147,676 | 2/1974 | Merrill | 128/891 |
| 882,357 | 3/1908 | Tietjen | 128/891 |
| 2,534,934 | 12/1950 | Viniegra | 128/891 |
| 2,574,132 | 11/1951 | Sutter | 128/891 |
| 2,808,592 | 10/1957 | Schwarz | 2/403 |
| 2,831,486 | 4/1958 | Sanders | 128/891 |
| 3,176,686 | 4/1965 | Barnes | 128/846 |
| 3,339,208 | 9/1967 | Marbach | 128/891 |
| 3,909,847 | 10/1975 | Holt | 128/891 |
| 4,155,360 | 5/1979 | Erickson | 128/891 |
| 4,184,494 | 1/1980 | King, Jr. | 450/95 |
| 4,229,835 | 10/1980 | Shaw | 2/406 |

FOREIGN PATENT DOCUMENTS

| | | | |
|---|---|---|---|
| 0841125 | 4/1962 | France | 128/DIG. 15 |

*Primary Examiner*—Michael A. Brown
*Attorney, Agent, or Firm*—Thomas R. Lampe

[57] ABSTRACT

An apparatus for shielding and protecting the pelvic and crotch area of a human female, wherein the apparatus includes a rigid, inflexible shield that has a first and a second shield element, and tab members that have tapered side walls that engage the front of the wearer's body to resist upward movement.

8 Claims, 4 Drawing Sheets

APPARATUS FOR SHIELDING AND PROTECTING THE PELVIC AND CROTCH AREA OF A HUMAN FEMALE

TECHNICAL FIELD

This invention relates to an apparatus for shielding and protecting the pelvic and crotch area of a human female. The invention is applicable, for example, as a shield and protector for individuals engaged in the martial arts or other contact sports or persons such as policewomen who may be subject to physical attack.

BACKGROUND ART

A number of devices are known in the prior art which have as their objective the protection of the human genital area. Some of these devices are applicable to both sexes while others are specifically adapted for use by either males or females.

A search of the prior art located the following U.S. patents, some of which relate to athletic protective devices affording a degree of protection against blows or impact applied to the vicinity of the pelvis or crotch: U.S. Pat. No. 3,176,686, issued Apr. 6, 1965, U.S. Pat. No. 4,229,835, issued Oct. 28, 1980, U.S. Pat. No. 3,909,847, issued Oct. 7, 1975, U.S. Pat. No. 2,574,132, issued Nov. 6, 1951, U.S. Pat. No. 4,184,494, issued Jan. 22, 1980, U.S. Pat. No. 2,808,592, issued Oct. 8, 1957, U.S. Pat. No. 2,534,934, issued Dec. 19, 1950, and U.S. Pat. No. 3,339,208, issued Sep. 5, 1967.

Some of these prior art patents are worthy of special comment.

U.S. Pat. No. 3,909,847 discloses a female pelvis and crotch protector which includes an outer shield layer or ply which is flexible enough to be bent but purportedly rigid and tough enough to resist deformation under relatively hard shocks. The pad of U.S. Pat. No. 3,909,847 is generally hour-glass shaped, having enlarged front and rear portions. The generally triangular rear portion would obviously result in some discomfort to the wearer. The inner surface of the pad of U.S. Pat. No. 3,909,847 conforms to the wearer's body throughout its extent and such configuration means that the force of a kick or blow sustained in the practice of the martial arts, for example, will immediately be directly transferred by the pad to the body of the wearer at the location where outside forces are applied to the pad. If this is at the genital or crotch area of the wearer pain and possible injury can result therefrom.

U.S. Pat. No. 3,339,208 discloses a bathing brief. The brief includes a spring and a flexible enclosure for the spring. This article is for the purpose of fitting between the wearer's legs, and while it may afford a modicum of coverage for the wearer's genital area, there is no protection provided in the event of a blow or kick being directed to the covered area. The enclosure is formed of flexible textile, rubber, or other plastic sheet or film materials.

DISCLOSURE OF INVENTION

The present invention relates to apparatus for shielding and protecting the pelvic and crotch area of a human female. The apparatus is of relatively simple, inexpensive construction. The shape of the apparatus is such that it is comfortable to wear while at the same time effectively affording the wearer protection against blows directed to the covered area.

The apparatus is configured in such a manner as to distribute and absorb shocks to a location on the wearer's body away from the genital area. Furthermore, the apparatus constructed in accordance with the teachings of the present invention provides for a degree of ventilation where it covers the wearer's body.

The apparatus of the present invention comprises a rigid, inflexible shield member of unitary construction to be placed between the wearer's legs and extend upwardly therefrom at the front of the wearer's body.

The shield member comprises first and second integral shield elements fixed in position relative to each other and having adjoining inner surfaces defining a fixed interior angle therebetween.

The first shield element is elongated and has a generally uniform width along substantially the full length thereof. The second shield element includes a terminal end remote from the first shield element and side edges leading to the terminal end. The side edges diverge away from one another in the direction of the terminal end.

The apparatus additionally comprises means for engaging the front of the wearer's body to resist upward movement of the second shield element when an upwardly directed external force is applied to the apparatus. This can occur, for example, when a kick or other blow is administered to the apparatus.

The second shield element includes a central portion and a pair of tab members disposed in opposition to one another and at least partially defining the side edges.

In an alternative embodiment, the apparatus additionally comprises cushioning material and means removably connecting the cushioning material to the rigid, inflexible shield member. The cushioning material is positionable between the shield member and the wearer's body. This arrangement enables the cushioning material to be removed and attached at will. Cleaning of the shield member and the cushioning material is facilitated by this arrangement.

Other features, advantages, and objects of the present invention will become apparent with reference to the following description and accompanying drawings.

BEST MODE FOR CARRYING OUT THE INVENTION

Figure 2:
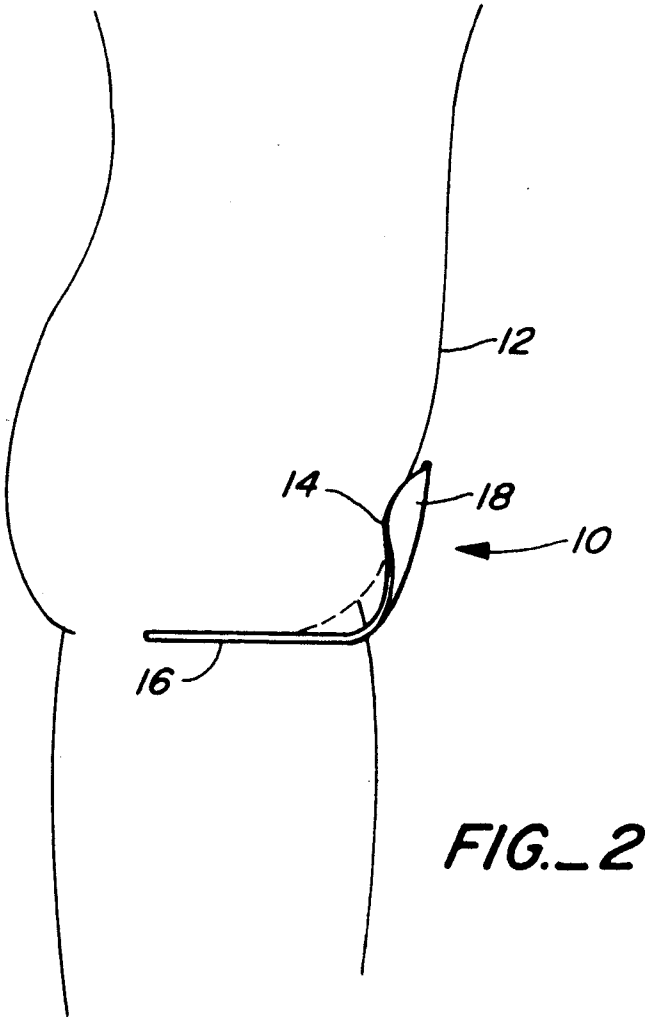
FIG. 2 is a side view of the apparatus of the present invention in position on a human female.
Figure 1:
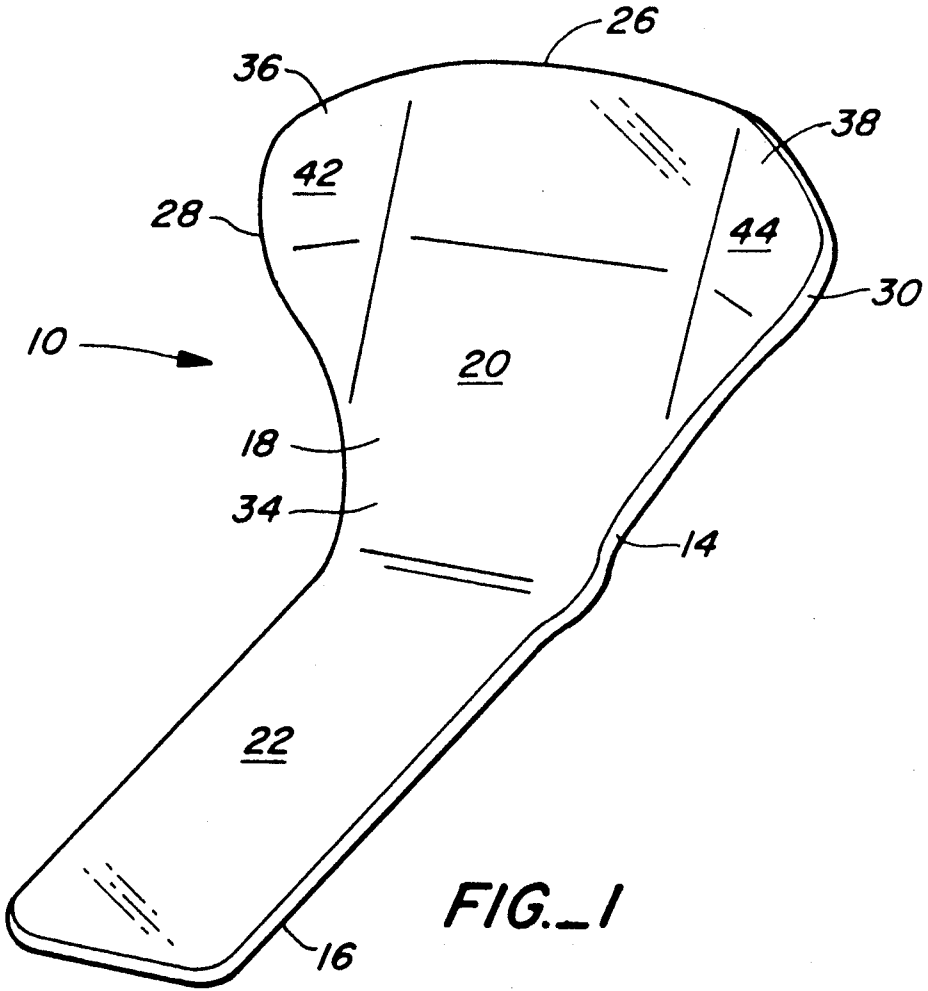
FIG. 1 is a frontal view of the shield element of the present invention.
Figure 4:
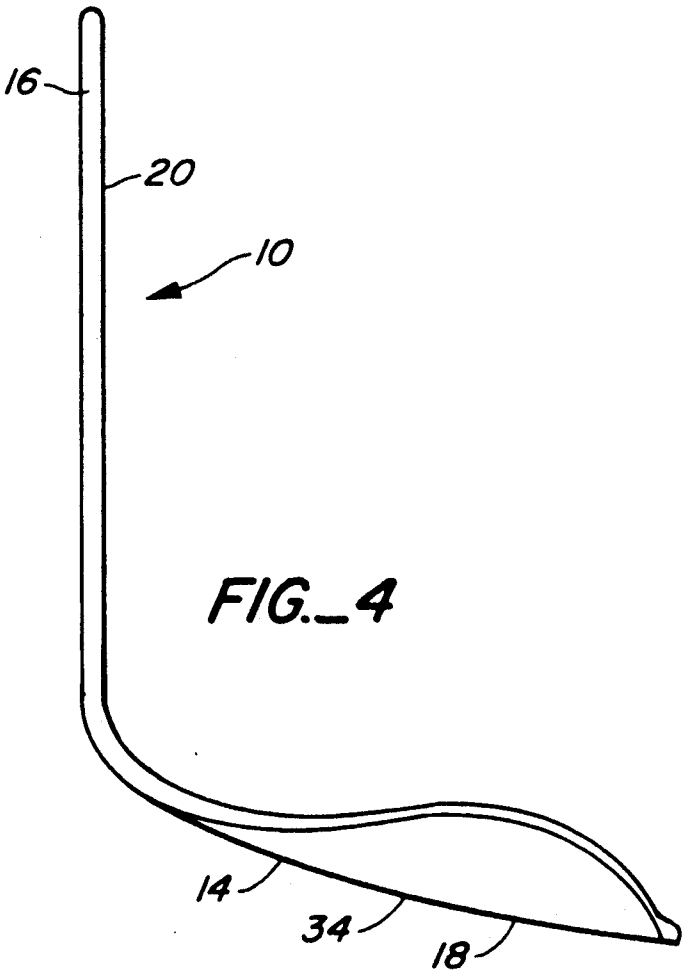
FIG. 4 is a side view of the shield element.
Figure 3:
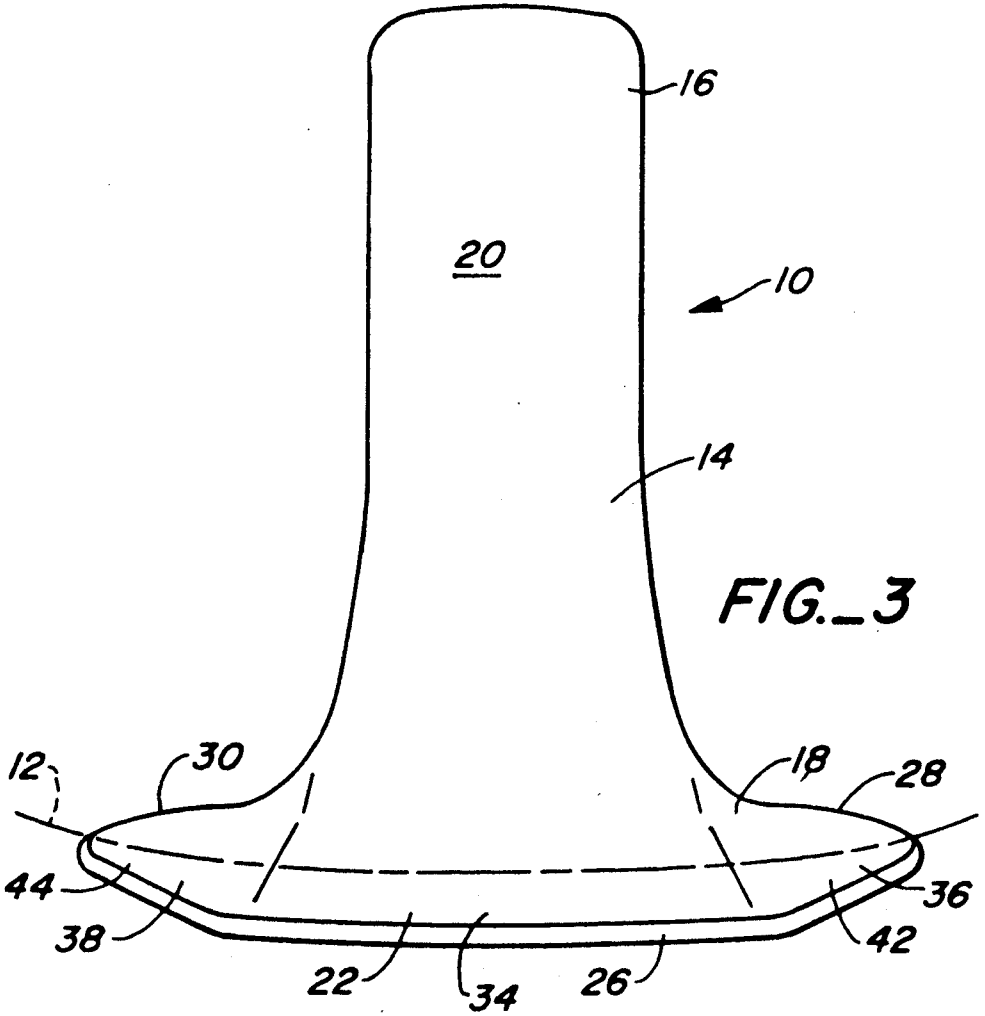
FIG. 3 is a top plan view of the shield element showing its relationship with a wearer's body.
Figure 5:
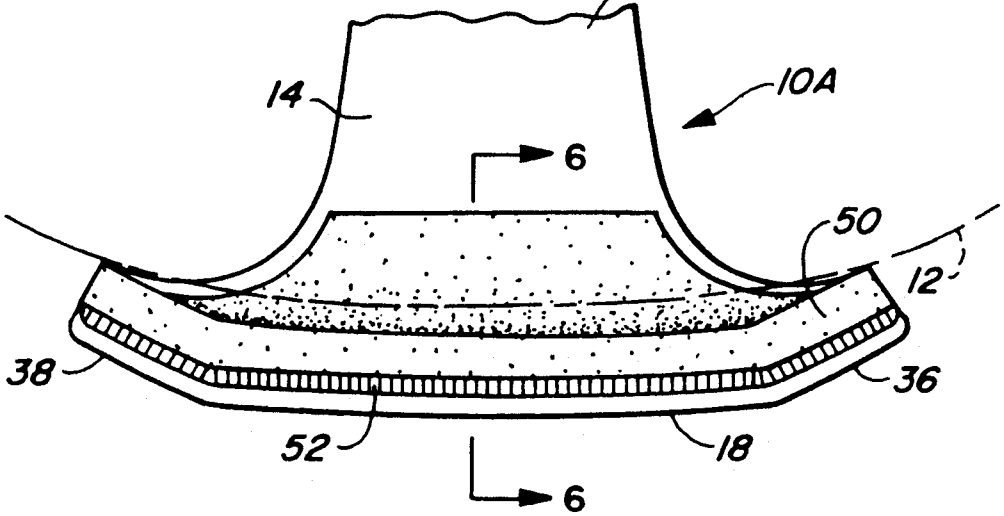
FIG. 5 is a view similar to FIG. 3 but illustrating an alternative embodiment wherein the shield element has cushioning material releasably attached thereto.

Referring now to FIGS. 1–4 of the drawings, apparatus constructed in accordance with the teachings of the present invention is designated by reference numeral 10. Apparatus 10 is for the purpose of shielding and protecting the pelvic and crotch area of a human female. A portion of the female body is shown in FIGS. 2, 3 and 5 and designated by reference numeral 12. For example, the apparatus may be utilized when the wearer is engaged in the practice of martial arts or engaged in other sports activities.

The apparatus 10 includes a rigid, inflexible shield member of unitary construction. A material found to be especially suitable is rigid plastic material, and even more particularly polycarbonate thermoplastic material, which is molded or otherwise fabricated to provide the shape shown in the drawings. In practice, the apparatus is located between the wearer's body and an article of clothing, such as underwear (not shown).

The shield member, designated by reference number 14, includes a first shield element 16 and a second shield element 18 integral therewith. First and second shield elements 16, 18 are fixed in position relative to each other and have adjoining inner surfaces 20, 22, respectively, which define a fixed interior angle therebetween. In the arrangement illustrated, the fixed interior angle should be at least 90 degrees.

The first shield element 16 is elongated and has a generally uniform width along substantially the full length thereof. The first shield element 16 is inserted between the legs of the wearer and it has been found that the shape illustrated provides a high degree of comfort.

The second shield element 18 includes a terminal end 26 remote from the first shield element and side edges 28, 30 leading to the terminal end. As may clearly be seen, the side edges 28, 30, diverge away from one another in the direction of the terminal end.

The second shield element 18 includes a central portion 34 and a pair of tab members 36, 38 disposed in opposition to one another and at least partially defining the side edges. As may be seen with reference to FIGS. 2 and 3, tab members 36, 38 comprise means for engaging the front of the wearer's body when the apparatus is positioned with the first shield element 16 at the wearer's crotch.

Tab members 36, 38 have tapered side walls 42, 44, respectively, which project inwardly toward the wearer's body when the apparatus is being worn. The side walls extend between the first shield element 16 and the terminal end 26 of the second shield element 18, tapering outwardly in the direction of the terminal end. Rounded corners are formed at the intersection of the tab members and the terminal end.

The inner surface of central portion 34, i.e. the surface facing the wearer, is planar as are the inner surfaces of the tab members. The tab member planar inner surfaces diverge away from each other with the central portion inner surface defining obtuse angles with each of the tab member planar inner surfaces.

The tab members, which engage the front of the wearer's body when the apparatus 10 is worn, serve a dual function. First of all, the tab members cooperate with the wearer's body to absorb and distribute forces applied to the apparatus as by kicking or striking which commonly occurs when practicing the martial arts. Other sports and activities also commonly give rise to impact in the pelvic and genital area. The shock thereof, due to engagement between the tab members and the wearer's lower abdominal area, will relieve some of the impact from the lower pelvic and genital area. That is, some of the force will be taken up by the front of the wearer's body where engagement with the tab members occurs.

The tab members also serve the function of providing a degree of ventilation to the wearer's body covered by the apparatus since the tab members maintain a space between the central portion 34 and the wearer's body.

Figure 6:
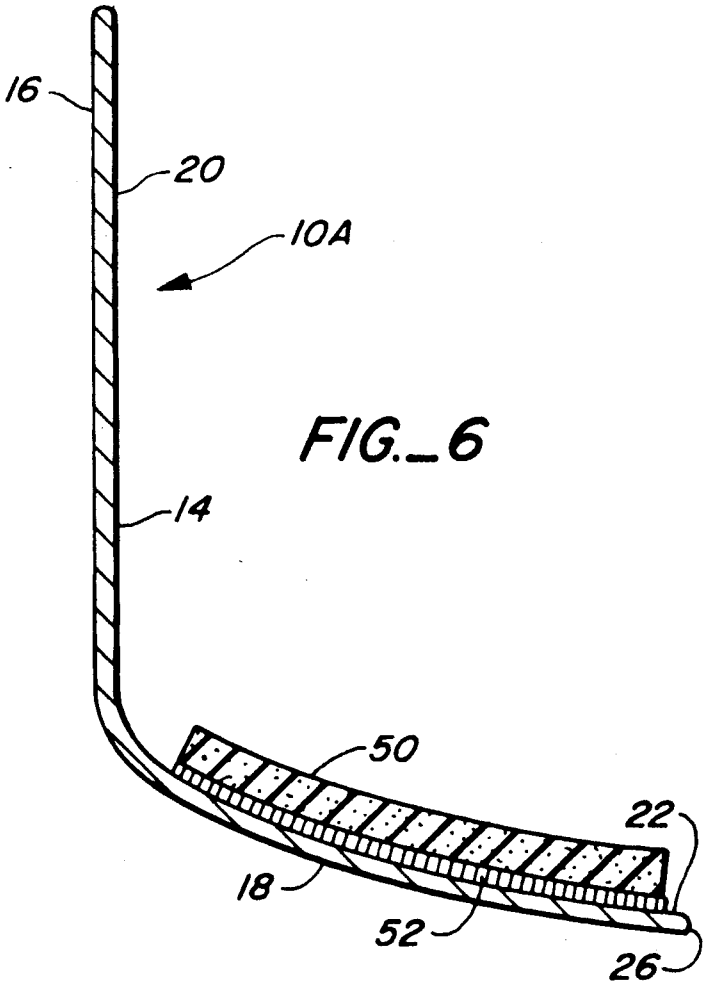
FIG. 6 is a cross-sectional view taken along line 6—6 of FIG. 5.

Referring now to FIGS. 5 and 6, an alternative form of apparatus 10A additionally comprises a layer of cushioning material 50 as well as means for removably connecting the cushioning material to the rigid, inflexible shield member 14. The cushioning material is located between the shield member and the wearer's body and is generally coextensive with the shield member when connected thereto. A suitable cushioning material is closed cell plastic foam.

The preferred means for removably connecting the cushioning material to the shield member is synthetic fastener material such as Velcro synthetic fastener material 52. Because the cushioning material and the shield member may be readily separated when desired, cleaning of the apparatus is facilitated.

The tab members of apparatus 10A cooperate with the wearer's body to distribute shock in the same manner as the tab members of apparatus 10 except that if the tab members are covered by cushioning material, engagement between the wearer's body and the tab members is indirect rather than direct.

Figure 7:
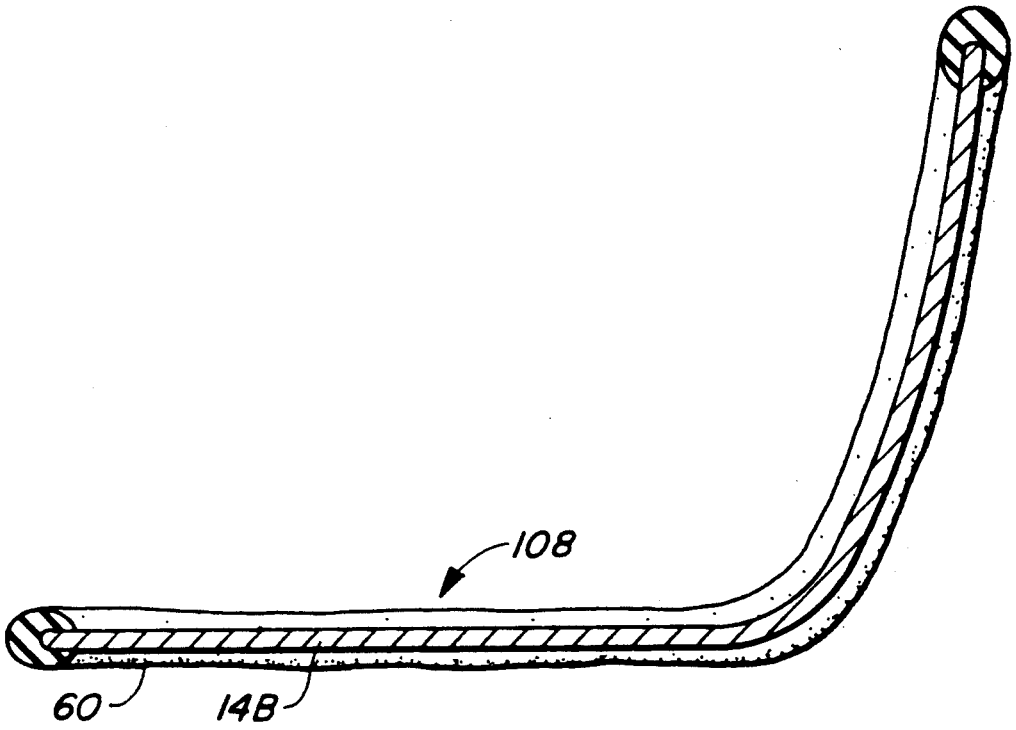
FIG. 7 is a cross-sectional side view of another alternative embodiment of the invention.

FIG. 7 discloses an alternative form of the apparatus 10B wherein shield member 14B is completely surrounded by and imbedded in rubber border 60. Border 60 maintains a space between the body of the wearer and the shield member and helps to absorb shock. The border may be of any suitable material, such as plastic, which would serve the same function.

I claim:

1. Apparatus for shielding and protecting the pelvic and crotch area of a human female, said apparatus comprising a rigid, inflexible shield member of unitary construction to be placed between the wearer's legs and extend upwardly therefrom at the front of the wearer's body, said shield member comprising rigid first and second integral shield elements fixed in position relative to each other and having adjoining inner surfaces defining a fixed interior angle therebetween, said first shield element being elongated and having a generally uniform width along substantially the full length thereof and said second shield element including a terminal end remote from said first shield element and side edges leading to the terminal end, said side edges diverging away from one another in the direction of said terminal end, said apparatus additionally comprising means for engaging the front of the wearer's body to resist upward movement of said second shield element and absorb shock when an external force is applied to said apparatus, said second shield element including a central portion and pair of tab members disposed in opposition to one another and at least partially defining said side edges, said tab members being rigid and comprising said means for engaging the front of the wearer's body, each of said tab members have a tapered side wall projecting inwardly toward said wearer's body when said apparatus is being worn, said side walls extending between said said first shield element and the terminal end of said second shield element and tapering outwardly in the direction of said terminal end, said second shield element inner surface including a central portion inner surface and tab member inner surfaces, said central portion inner surface being planar, and said tab member inner surfaces being planar and diverging away from each other in the general direction of the wearer's body with said central portion inner surface defining obtuse angles with each of said tab member planar inner surfaces, said tab members when engaging the wearer's body maintaining at least some of said central portion inner surface spaced from the wearer's body.

2. The apparatus according to claim 1 wherein said tab members have rounded corners engageable with the wearer's body.

3. The apparatus according to claim 1 additionally comprising cushioning material and means removably connecting said cushioning material to said rigid, inflexible shield member, said cushioning material positionable between the shield member and the wearer's body.

4. The apparatus according to claim 3 wherein said cushioning material is generally coextensive with said shield member when removably connected thereto.

5. The apparatus according to claim 3 wherein said means removably connecting said cushioning material to said rigid, inflexible shield member comprises synthetic fastener material.

6. The apparatus according to claim 1 wherein said shield is constructed of molded sheet plastic material.

7. The apparatus according to claim 6 wherein the plastic material is polycarbonate thermoplastic material.

8. The apparatus according to claim 1 including a border of resilient material extending about said shield member to absorb shock when an external force is applied to said apparatus and maintain a space between said shield member and the body of the wearer.

* * * * *